United States Patent [19]

Pringle

[11] Patent Number: 4,716,969

[45] Date of Patent: Jan. 5, 1988

[54] HYDRAULIC VALVE ACTUATING MEANS FOR SUBSURFACE SAFETY VALVE

[75] Inventor: Ronald E. Pringle, Houston, Tex.

[73] Assignee: Camco, Incorporated, Houston, Tex.

[21] Appl. No.: 2,323

[22] Filed: Jan. 12, 1987

[51] Int. Cl.[4] ..... E21B 34/10

[52] U.S. Cl. ..... 166/321; 166/332

[58] Field of Search ..... 166/319, 321, 322, 323, 166/324, 332, 375, 72, 320; 251/62, 63, 63.4, 63.5, 63.6

[56] References Cited

U.S. PATENT DOCUMENTS

| | | | |
|---|---|---|---|
| 4,527,630 | 7/1985 | Pringle | 166/321 |
| 4,569,398 | 2/1986 | Pringle | 251/62 |
| 4,574,889 | 3/1986 | Pringle | 166/323 |
| 4,601,341 | 7/1986 | Pringle | 166/321 |

*Primary Examiner*—James A. Leppink

*Assistant Examiner*—Terry Lee Melius

*Attorney, Agent, or Firm*—Fulbright & Jaworski

[57] ABSTRACT

A subsurface safety valve having a piston and cylinder assembly for actuating the safety valve. First and second flow sealing valves are positioned in communication with a flow control passageway to the assembly in which said first and second valves open and close in response to the movement of the piston relative to the cylinder. The first valve shuts off fluid flow from the fluid control passageway to the assembly when the safety valve is open and the second valve to shuts off fluid flow from the cylinder to the fluid control passageway when the safety valve is closed. A third valve may be positioned on the side of the piston in communication with the fluid control passageway and is redundantly positioned with the second valve. A lost motion connection may be provided for sequentially actuating the second and third valves.

5 Claims, 4 Drawing Figures

HYDRAULIC VALVE ACTUATING MEANS FOR SUBSURFACE SAFETY VALVE

BACKGROUND OF THE INVENTION

It is known in U.S. Pat. No. 4,527,630 to provide a hydraulically actuated well safety valve with first and second flow sealing valves. The first sealing valve is positioned to shut off fluid flow from a fluid control passageway to the piston and cylinder assembly when the safety valve is in the open position and the second sealing valve is positioned to shut off fluid flow from the cylinder to the flow control passageway when the safety valve is in the closed position. In such a safety valve biasing fluid in the safety valve advantageously acts against the piston and cylinder assembly in a direction to move the safety valve to the closed position. However, contaminants in the biasing fluid collect on the second flow sealing valve element and valve seat and prevent the second valve from providing a gas tight seal. Therefore, gas may escape from the biasing fluid which comprises well production fluid. Such gases, which are flammable, may flow through the piston and cylinder assembly and up the fluid control passageway to the well surface to affect the fluid control operation of the safety valve and to create a hazardous surface condition.

The present invention is directed to the provision of a well subsurface safety valve having a hydraulic valve actuating means including flow sealing valves which are positioned out of direct contamination with the biasing fluid for reducing the possibility of gas escaping to the fluid control passageway.

SUMMARY

The present invention is directed to a subsurface well safety valve for controlling the fluid flow through a well conduit and including a housing having a bore and a valve closure member moving between open and closed positions for controlling the fluid flow through the bore. A tubular member telescopically moves in the housing for controlling the movement of the valve closure member and biasing means moves the tubular member in a direction to close the valve. An improved fluid actuating means for actuating the valve closure member includes a cylinder in the housing and a piston in and movable relative to the cylinder in response to fluid pressure in the cylinder and one of the cylinder and piston engages and moves the tubular member. The cylinder on one side of the piston is adapted to be in communication with a fluid control passageway to the well surface and the cylinder on the second side of the piston is adapted to be in communication with a biasing fluid in the bore. First and second fluid sealing valves are positioned on said one side of the piston and each of said valves are opened and closed in response to movement of the piston relative to the cylinder. The first valve is positioned to shut off fluid flow from the fluid control passageway to the cylinder when the safety valve is in the open position and the second valve is positioned to shut off fluid flow from the cylinder to the fluid control passageway when the safety valve is in the closed position.

Still a further object of the present invention is wherein the piston includes first and second portions movable relative to each other and a metal seal is positioned between the two portions of the piston. Preferably each of the two portions of the piston include tapered surfaces facing each other and the seal is an O-ring seal which increases its sealing against the cylinder when force is applied in the piston.

Yet a still further object of the present invention is the provision of a third flow sealing valve positioned on said one side of the piston and opened and closed in response to movement of the piston relative to the cylinder and positioned to shut fluid flow from the cylinder to the fluid control passageway when the safety valve is in the closed position.

Still a further object of the present invention is the provision of a lost motion connection between the second valve and the third valve for sequentially actuating the second and third valves.

Yet a still further object of the present invention is wherein on of the second and third valves includes wedging seal surfaces for sealing between the piston and cylinder.

Still a further object of the present invention is wherein the first, second and third valves include metal valve elements and metal valve seats.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

While the present invention will be described in connection with a subsurface tubing safety valve having a flapper type valve closure member, it is understood that the present invention may be used with other types of safety valves and other types of valve closure members.

Figure 1:
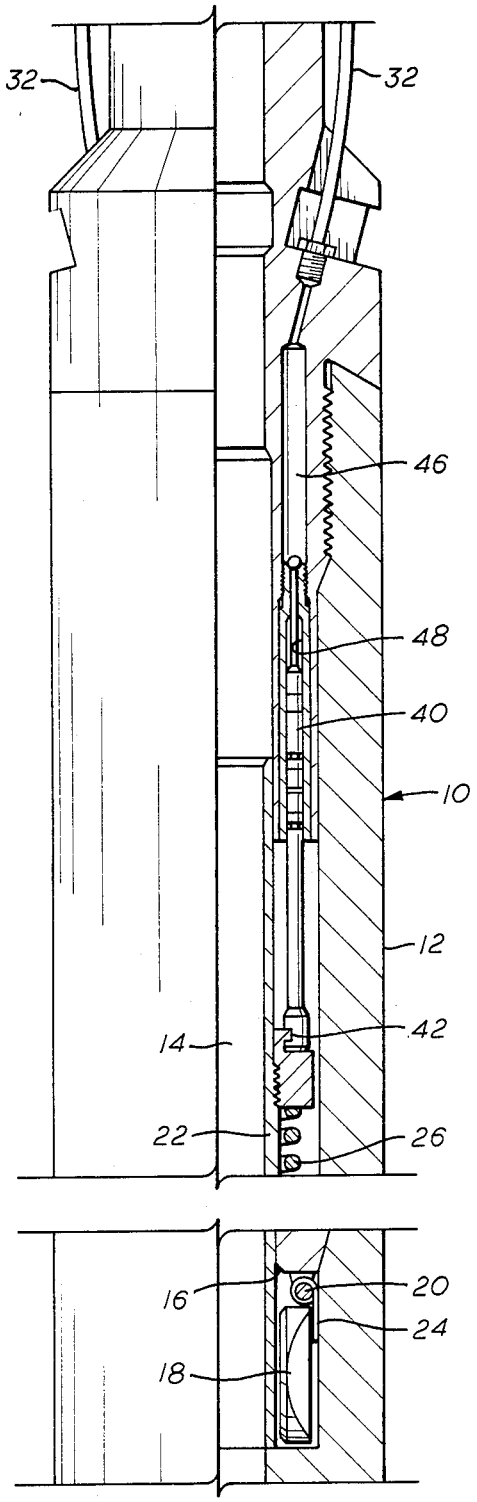
FIG. 1 is an elevational, fragmentary view, in quarter section, of a well safety valve utilizing the present invention and shown in the position.

Referring now to the drawings, and particularly to FIG. 1, the reference numeral 10 generally indicates a subsurface tubing safety valve of the present invention which includes a body or housing 12 which is adapted to be connected in a well tubing to permit well production therethrough under normal operating conditions, but in which the safety valve 10 may close or be closed in response to abnormal conditions.

The valve 10 includes a bore 14, an annular valve seat 16 positioned about the bore 14, a valve closure element such as a flapper valve 18 connected to the body 12 by pivot pin 20. Thus, when the flapper valve 18 is in the upward position and seated on the valve seat 16, the safety valve is closed blocking flow upwardly through the bore 14 and well tubing.

A flow tube or tubular member 22 is telescopically movable in the body 12 and through the valve seat 16. As best seen in FIG. 1, when the tubular member 22 is moved to a downward position, the tube 22 pushes the flapper 18 away from the valve seat 16. Thus, the valve 10 is held in the open position so long as the tube 22 is in the downward position. When the tube is moved upwardly, the flapper 18 is allowed to move upwardly on to the seat 16 by the action of a spring 24.

The flow tube 22 is biased in an upward direction by a suitable means which may include a spring 26 for yieldably urging the member 22 in a upward direction to release the flapper 18 for closing the valve 10. The safety valve 10 is controlled by the application or removal of a pressurized fluid, such as hydraulic fluid, through a control path or line, such as a control line or lines 32 extending to the well surface or the casing annulus. Pressurized fluid is supplied to a hydraulic piston and cylinder assembly which in turn engages the tubular member 22 to move the member 22 downwardly forcing the flapper 18 off of the seat and into the full open position. The safety valve 10 is controlled by the application or removal of pressurized fluid through the control lines 32 and a fluid passageway 46 to supply hydraulic controlled pressurized fluid to a piston and cylinder assembly including a piston 40 in and movable relative to a cylinder 48 in response to the fluid pressure in the cylinder. Either the cylinder 48 or the piston 40 may engage and move the tubular member 40, here shown as the piston 40 which engages the tubular member 22 by a connection 42. The bottom of the piston and cylinder assembly is exposed to fluid pressure of the well fluid in the bore 14 which flows around the flow tube 22 and acts against one of the piston and cylinder, here shown as the bottom of the piston 40, for biasing the tubular member 22 to the closed position when fluid control pressure is removed from the control line 32.

The piston 40 is preferably a metal piston, such as in the form of cup seals, to obtain desirable sealing under adverse temperature, and a corrosive fluid and gas environment. However, the metal piston 40 is subject to wear and tear in its hostile environment and may leak, particularly in attempting to seal gases. The present invention is directed to providing positive flow sealing valves, preferably metal, which provide a Positive seal in both directions, even in the event of a fluid bypass between the piston 40 and the cylinder 48.

The above description is generally disclosed in my U.S. Pat. No. 4,527,630. However, it has been found that the lower flow sealing valve which is exposed to well fluids in the bore 14 would become contaminated with buildup of material on its valve element and valve seat and was subject to gas leakage. The gas leakage, which includes flammable hydrocarbons, would leak past the piston and into the fluid control line and migrate up to the well surface. This gas would not only affect the operation of the safety valve by changing the density of the fluid in the control line, but would allow the dangerous and flammable gases to collect at the well surface.

Figure 2:
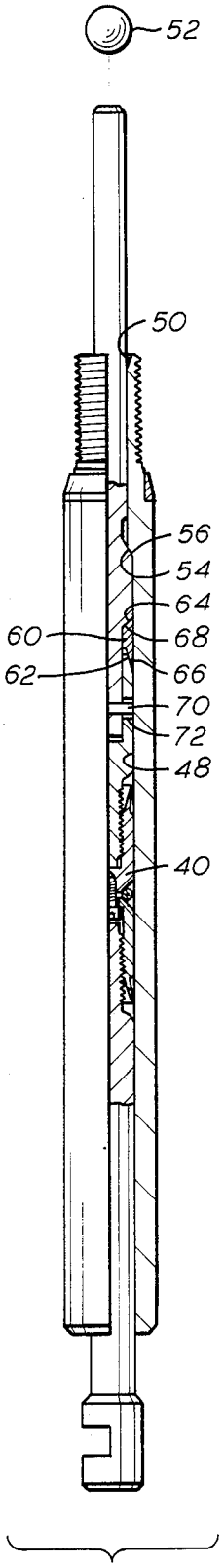
FIG. 2 is an enlarged cross-sectional view of one embodiment of the hydraulic actuating means of FIG. 1 with the hydraulic act means being in its upward position.

Referring now to FIG. 2, a first fluid sealing valve is provided which may include a valve seat 50 and a valve element 52. The metal seat 50 may be connected to the cylinder 48 and the valve element 52 may be connected to the piston 40 or merely floating free. The seat 50 and element 52 are positioned on the side of the piston 40 in communication with the fluid control passageway 46 and control line 32 and is opened and closed in response to movement of the piston 40 relative to the cylinder 48. The first flow sealing valve is positioned to shut off fluid flow from the fluid control passageway 26 and line 32 when the valve 10 is in the open position.

A second flow sealing valve is provided which may include a metal valve seat 54, such as on the cylinder 48 and a valve element 56, such as on the piston 40. This second valve, is also positioned on the side of the piston which is in communication with the fluid control passageway 46 and line 32. This second valve is opened and closed in response to movement of the piston 40 relative to the cylinder 48 and is positioned to shut off fluid flow from the cylinder 48 to the fluid control passageway 46 when the safety valve 10 is in the closed position. It is to be particularly noted that the second flow sealing valve consisting of seat 54 and element 56 are positioned with the cup seals of the piston 40 between the second fluid sealing valve and the biasing fluid in the well bore 14. Therefore, the piston 40 which may not be gas tight, provides a sufficient sealing action against the cylinder 48 to restrict the passage of particulate matter in the well fluids to the valve seat 54 and valve element 56. Therefore, this second fluid sealing valve is able to maintain a gas type metal-to-metal seal as it is not subject to the contamination as the valve in U.S. Pat. No. 4,527,630.

In addition, a third flow sealing valve may be positioned on the side of the piston 40 in communication with the flow control passageway 46 and line 32 and opened and closed in response to movement of the piston relative to the cylinder 48 and positioned to shut fluid flow from the cylinder 48 to the fluid control passageway 46 when the safety valve 10 is in the closed position. This third flow sealing valve consists of a valve sealing element 60 having a first tapered surface 62 and a second tapered wedging surface 64. The tapered wedging surface 62 is actuated into a sealing engagement with the interior of the cylinder 48 by shoulder 66 on the piston 40 which also drives the tapered surface 64 against a coacting tapered surface 68 on the piston 40. Thus, the seal element 60 seals against both the piston 40 and the cylinder 48 to provide a redundant seal with the second flow sealing valve. A lost motion connection is provided in the piston 40 consisting of a pin 70 movable in a slot 72. This allows a sequential and positive setting of the second and third flow sealing valves. When the piston 40 moves upwardly, the shoulder 62 moves the valve seal element 60 upwardly against surface 68 carrying the valve element 56 into engagement with the valve seat 54. Thereafter, the lost motion connection allows the shoulder 66 to move further upwardly to increase the seal of sealing member 60 and its tapered surfaces 62 and 64 against the cylinder 48 and piston 40. On downward movement of the piston 40, the piston is subjected to hydraulic fluid pressure in the control passageway 46. After the valve element 56 unseats from the seat 54, the lost motion connection 70 and 72 allows the valve element 56 to move downwardly without dragging the set seal 60 along the cylinder 48 until the piston 40 may be actuated by the fluid pressure to withdraw the shoulder 66 from engagement with the seal 60.

Figure 3:
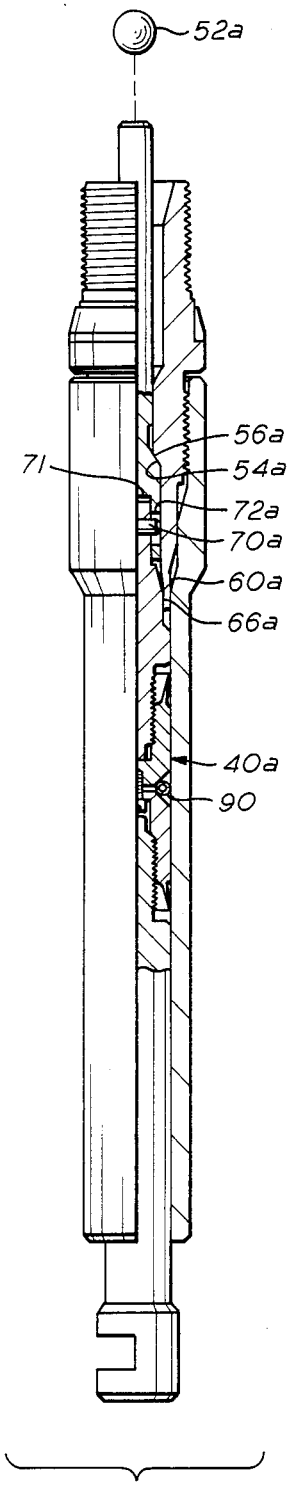
FIG. 3 is an enlarged cross-sectional view of another embodiment of a hydraulic actuating means.
Figure 4:
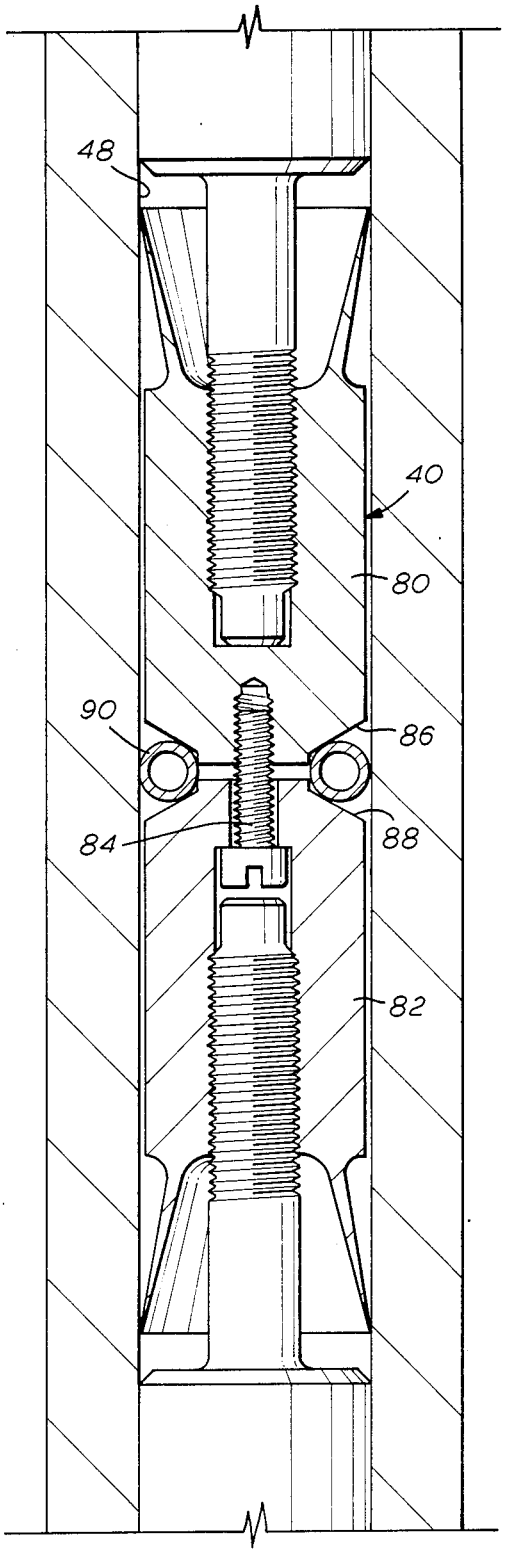
FIG. 4 is an enlarged fragmentary, cross-sectional view of the piston of the present invention.

In order to increase the sealing ability of the piston 40 against contaminants in the well fluid in the bore 14 from reaching the second and third flow sealing valves, an improved type of piston may be used. Referring now to FIGS. 2, 3, and 4, the piston 40 may include a first portion 80 having upwardly directed sealing cups and a downwardly directed portion 82 having downwardly directed sealing cups. The two portions 80 and 82 are connected together by a bolt 84 which is threaded into member 80 but is slidable in member 82. Therefore, the two portions 80 and 82 have limited movement relative to each other. The portions 80 and 82 include tapered surfaces 86 and 88, respectively, facing each other with a seal, preferably an O-ring metal seal 90, positioned therebetween. Therefore, when an actuating force is placed upon the piston 40, either fluid or the force of the biasing spring 26, the piston portions 80 and 82 will move together and compress the seal 90 outwardly into a greater sealing relationship with the cylinder 48 to reduce the possibility of contaminants in the well fluids from bypassing the piston 40.

Other and further embodiments of the hydraulic valve actutating means of the present invention may be provided such as shown in FIG. 3 wherein like parts to those in FIGS. 1 and 2 are similarly numbered with the addition of the suffix "a". In FIG. 3, the first flow sealing valve which consists of valve element **56*a* and seat 54*a* is actuated into engagement by fluid pressure when the safety valve 10 opens. Also, upward movement of the piston 40*a* moves shoulder 66*a* upwardly to engage the wedging seal 60*a* which is urged into a sealing relationship with both the piston 40*a* and the cylinder 48*a*. On opening the valve 10, downward movement of the hydraulic pressure moves the valve element 56*a* downwardly, then moves piston 40*a* downwardly to pull the shoulder 66*a* downwardly. Again, the lost motion connection between the pin 70*a* and the space 72*a* allows sequential movement of the first and second flow sealing valves. That is, a spring, such as wave spring 71, is provided in the lost motion connection to insure that element 56*a* seats on seat 54*a* to close and seal the first sealing valve before the shoulder 66*a* seals the wedging seal 60*a*** of the second flow sealing valve.

In operation, when hydraulic control fluid is supplied through the line 32 fluid will flow into the passageway 46 and open the first flow sealing valve, moving elements 56 and **56*a*, respectively, from the seats 54 and 54*a*. The hydraulic fluid then acts on piston 40 and 40*a* moving them downwardly to carry the flow tube 22 downwardly to open the flapper 18. Further downward movement of the piston 40 allows the valve element 52 or 52*a* to move downwardly and seat on the valve seat 50 and 50*a*, respectively, to provide a positive seal to prevent fluid flow from the passageway 46 into the cylinder 48. When it is desired to close the valve, pressure in the hydraulic control line 32 is reduced. The fluid pressure in the bore 14 of the safety valve 10 is in communication with the cylinder 48 and the bottom of the piston 40 and along with the spring 26 biases the piston 40 in an upward direction to allow the flapper 18** to close.

In the embodiment of FIG. 2, upward movment of the piston 40 moves the shoulder 66 upwardly to engage the sealing valve element 60 against element 56 causing the second flow sealing valve element 56 to seat and seal on valve seat 54. Further upward movement of the shoulder 66 will cause the seal 60 with its tapered surfaces 62 and 64 to seal against both the piston on the seat 68 and against the inside of the cylinder 48 to form a second redundant seal. In the second embodiment shown in FIG. 3 on upward movement of the piston **40*a* the valve element 56*a* will seat on valve element 54*a* by fluid pressure and upward movement of the shoulder 66*a* will engage and seal the sealing element 60*a* against both the piston 40*a* and the inside of the cylinder 48*a***.

In both embodiments, the second and third flow sealing valves seal off fluid flow from the cylinder to the fluid control passageway 46 and line 32 and operate in a relatively clean environment to positively seal and prevent the escape of any gas from the well fluids into the fluid control passageway. Furthermore, the action of the movable piston portions 80 and 82 act against the metal O-ring seal 90 to further protect the second and third flow sealing valves from contamination by material in the well fluids.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, will readily suggest themselves to those skilled in the art and which are encompassed within the spirit of the invention and the scope of the appended claims.

What is claimed is:

1. In a subsurface well safety valve for controlling the fluid flow through a well conduit and including a housing having a bore and a valve closure member moving between open and closed positions for controlling the fluid flow through the bore, a tubular member telescopically moving in the housing for controlling the movement of the valve closure member, and biasing means for moving the tubular member in a direction to close the valve, the improvement in fluid actuating means for actuating the valve closure member comprising, a cylinder in the housing, a piston in and movable relative to the cylinder in response to fluid pressure in the cylinder, one of said cylinder and piston engaging and moving the tubular member, said cylinder on one side of the piston adapted to be in communication with a fluid control passageway, and said cylinder on the second side of the piston adapted to be in communication with a biasing fluid, first and second flow sealing valves, each of said valves are positioned on said one side of the piston and opened and closed in response to movement of the piston relative to the cylinder, said first valve positioned to shut off fluid flow from the fluid control passageway to the cylinder when the safety valve is in said open position, and the second valve positioned to shut off fluid flow from the cylinder to the fluid control passageway when the safety valve is in the closed position, said piston includes first and second portions movable relative to each other and a metal O-ring seal positioned between the two portions of the piston, each of the two portions of the piston including a tapered safe surface facing each other for engaging the metal seal for compressing the seal outwardly into a greater sealing relationship with the cylinder when the piston is actuated.

2. In a subsurface well safety valve for controlling the fluid flow through a well conduit and including a housing having a bore and a valve closure member moving between open and closed positions for controlling the fluid flow through the bore, a tubular member telescopically moving in the housing for controlling the movement of the valve closure member, and biasing means for moving the tubular member in a direction to close the valve, the improvement in fluid actuating means for actuating the valve closure member comprising, a cylinder in the housing, a piston in and movable relative to the cylinder in response to fluid pressure in the cylinder, one of said cylinder and piston engaging and moving the tubular member, said cylinder on one side of the piston adapted to be in communication with a fluid control passageway, and said cylinder on the second side of the piston adapted to be in communication with a biasing fluid, first and second flow sealing valves, each of said valves are positioned on said one side of the piston and opened and closed in repsonse to movement of the piston relative to the cylinder, said first valve positioned to shut off fluid flow from the fluid control passageway to the cylinder when the safety valve is in said open position, and the second valve positioned to shut off fluid flow from the cylinder to the fluid control passageway when the safety valve is in the closed position, and a third flow sealing valve positioned on said one side of the piston and opened and closed in response to movement of the piston relative to the cylinder and positioned to shut fluid flow from the cylinder to the fluid control passageway when the safety valve is in the closed position.

3. The apparatus of claim 2 including, a lost motion connection between the second and the third valve for sequentially actuating the second and third valves.

4. The apparatus of claim 2 wherein, one of the second and third valves includes wedging seal surfaces for sealing between the piston and cylinder.

5. The apparatus of claim 2 wherein the first, second and third valves include metal valve elements and valve seats.

* * * * *